US009437972B2

(12) United States Patent
Endo et al.

(10) Patent No.: US 9,437,972 B2
(45) Date of Patent: Sep. 6, 2016

(54) ELECTRIC CONNECTOR

(71) Applicant: DAI-ICHI SEIKO CO., LTD., Kyoto (JP)

(72) Inventors: Takayoshi Endo, Shizuoka (JP); Shuji Touno, Shizuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 14/791,808

(22) Filed: Jul. 6, 2015

(65) Prior Publication Data

US 2015/0311627 A1 Oct. 29, 2015

Related U.S. Application Data

(62) Division of application No. 14/043,063, filed on Oct. 1, 2013.

(30) Foreign Application Priority Data

Oct. 10, 2012 (JP) ..... 2012-225380

(51) Int. Cl.
*H01R 13/631* (2006.01)
*H01R 13/627* (2006.01)
(Continued)

(52) U.S. Cl.
CPC ..... *H01R 13/629* (2013.01); *H01R 13/631* (2013.01); *H01R 13/6315* (2013.01); *H01R 13/645* (2013.01); *H01R 24/38* (2013.01); *H01R 24/58* (2013.01)

(58) Field of Classification Search
CPC .. H01R 13/631; H01R 13/627; H01R 9/038; H01R 12/57
USPC ..... 439/378, 352, 366, 579
See application file for complete search history.

(56) References Cited

U.S. PATENT DOCUMENTS 5,431,580 A 7/1995 Tabata
5,871,371 A 2/1999 Rothenberger et al.
(Continued)

FOREIGN PATENT DOCUMENTS

DE 2 248 268 4/1974
EP 0 626 737 11/1994
(Continued)

OTHER PUBLICATIONS

Japanese Office Action (OA) dated Sep. 17, 2013 in Japanese Patent Application No. 2012-225380.
Extended European Search Report issued Jan. 23, 2014 in corresponding European Application No. 13185569.4-1801.

*Primary Examiner* — Amy Cohen Johnson
*Assistant Examiner* — Matthew T Dzierzynski
(74) *Attorney, Agent, or Firm* — Wenderoth, Lind & Ponack, L.L.P.

(57) ABSTRACT

An electric connector includes a male connector and a female connector, the male connector including a cylindrical main portion, and a male contact terminal formed at the main portion. The female connector includes a hole into which the main portion is fit, and a female contact terminal formed at the hole for making electrical contact with the male contact terminal when the main portion is fit into the hole. One of the male connector and the female connector includes a guide shaft axially extending in a direction in which the male connector is fit into the female connector, and the other of the male connector and the female connector includes a guide hole for allowing the guide shaft to be inserted thereinto to guide the guide shaft in the direction.

8 Claims, 21 Drawing Sheets

(51) Int. Cl.

| | |
|---|---|
| ***H01R 13/629*** | (2006.01) |
| ***H01R 13/645*** | (2006.01) |
| *H01R 12/57* | (2011.01) |
| *H01R 24/38* | (2011.01) |
| *H01R 24/58* | (2011.01) |

(56) References Cited

U.S. PATENT DOCUMENTS

| | | | |
|---|---|---|---|
| 6,257,925 | B1 | 7/2001 | Jones |
| 7,004,778 | B2 | 2/2006 | Barker et al. |
| 8,328,574 | B1 | 12/2012 | Lin |
| 2002/0142666 | A1 | 10/2002 | Nishio et al. |
| 2005/0009390 | A1 | 1/2005 | Barker et al. |
| 2005/0173395 | A1 | 8/2005 | Haussner et al. |
| 2008/0281158 | A1 | 11/2008 | Miyagi et al. |
| 2010/0291802 | A1 | 11/2010 | Sawai et al. |
| 2012/0094553 | A1 | 4/2012 | Fujiwara et al. |

FOREIGN PATENT DOCUMENTS

| | | |
|---|---|---|
| EP | 2 442 404 A1 | 4/2012 |
| JP | 54-96793 | 7/1979 |
| JP | 9-35825 | 2/1997 |
| JP | 2002-298968 | 10/2002 |
| JP | 2005-207730 | 8/2005 |
| JP | 2006-73396 | 3/2006 |
| JP | 2007-521181 | 8/2007 |
| JP | 2008-52930 | 3/2008 |
| JP | 3176159 | 5/2012 |
| WO | 98/27626 | 6/1998 |

ELECTRIC CONNECTOR

BACKGROUND OF THE INVENTION

1. Field of the Invention

The invention relates to an electric connector including a male connector having a cylindrical main portion, and a female connector having a hole into which the main portion is fit.

2. Description of the Related Art

An electric connector such as a connector used in a glow plug acting as a spark plug or a pre-heater plug in an engine, and a connector used for electrically connecting a combustion pressure sensor to a wire harness, generally includes a cylindrical male connector. Since a portion of the male connector through which the male connector is fit into the female connector is rotation-symmetrical to the female connector, the male connector can be fit into the female connector, even if the male connector rotates in any direction about an axis thereof, ensuring that the male connector can be manually fit into the female connector even in invisible condition.

FIG. 23 is a perspective view of a plug connector and a receptacle connector both suggested in Japanese Patent Application Publication No. H9(1997)-35825. The plug connector 1000 includes a plug insulator 1001 in the rotation-symmetric form, and a plurality of plug contacts 1002 each disposed at different distances from a distal end of the plug insulator 1001. The receptacle connector 1010 includes a receptacle insulator formed with a fitting hole 1011 into which the plug insulator 1001 is fit, and a plurality of receptacle contacts 1012 disposed at an inner surface of the fitting hole 1011.

FIG. 24A is a cross-sectional view of a glow plug suggested in Japanese Patent Application Publication No. 2005-207730, and FIG. 24B is a perspective view of the glow plug illustrated in FIG. 24A.

The illustrated glow plug includes an electrically insulating casing 1100, a sensor contact 1101 disposed on an inner surface of the casing 1100 for making contact with a sensor (not illustrated) when the male and female connectors are fit into each other, sensor contacts 1102 and 1103 disposed on an outer surface of the casing 1100, and a contact 1104 disposed at a center of the casing 1100 and making contact with a contact (not illustrated) of a heater used for heating the glow plug when the male and female connectors are fit into each other.

In the conventional connector illustrated in FIG. 23, since the receptacle contacts 1012 of the receptacle connector 1010 making contact with the plug contacts 1002 of the plug connector 1000 are exposed at an inner surface of the fitting hole 1011, the receptacle contacts 1012 of the receptacle connector 1010 may be damaged, if the plug insulator 1001 is inserted into the fitting hole 1011 of the receptacle connector 1010 with an axis of the plug connector 1000 being inclined relative to an axis of the fitting hole 1011, or if the plug insulator 1001 is inserted obliquely into the fitting hole 1011 of the receptacle connector 1010, varying a direction in which the plug connector 1000 is inclined.

In the conventional glow plug illustrated in FIGS. 24A and 24B, since the contact 1104 is disposed at a center of the casing 1100, if the glow plug is inserted into a connector (not illustrated) with an axis of the glow plug being inclined, the contact 1104 makes frictional contact with an inner surface of a female connector, and may be damaged. Furthermore, since the sensor contact 1101 is disposed inside of the casing 1100, the contact 1101 makes frictional contact with an outer surface of a female connector, and may be damaged. If the contacts 1101 and 1104 of the glow plug as a male connector were damaged, reliability to electrical connection between the glow plug and a female connector would be deteriorated.

SUMMARY OF THE INVENTION

In view of the above-mentioned problems in the conventional connectors, it is an object of the present invention to provide an electric connector which is capable of preventing a male connector from being inserted into a female connector with an axis thereof being inclined, to thereby enhance reliability to electrical connection between the male and female connectors.

In one aspect of the present invention, there is provided an electric connector including a male connector and a female connector, the male connector including a cylindrical main portion, and a male contact terminal formed at the main portion, the female connector including a hole into which the main portion is fit, and a female contact terminal formed at the hole for making electrical contact with the male contact terminal when the main portion is fit into the hole, one of the male connector and the female connector including a guide shaft axially extending in a direction in which the male connector is fit into the female connector, the other of the male connector and the female connector including a guide hole for allowing the guide shaft to be inserted thereinto to guide the guide shaft in the direction.

In the electric connector in accordance with the present invention, one of the male connector and the female connector is designed to include a guide shaft axially extending in a direction in which the male connector is fit into the female connector, and the other is designed to include a guide hole for allowing the guide shaft to be inserted thereinto to guide the guide shaft in the direction. Since the guide shaft goes forwardly into the guide hole, the male and female connectors can be fit into each other with axes of them being coincident with each other. Thus, it is possible to prevent the male connector from being inserted into the female connector with an axis thereof being inclined relative to an axis of the female connector.

It is preferable that the guide shaft extends at a distal end thereof beyond the one of the male connector and the female connector.

Since the guide shaft extends beyond an opening end of the male or female connector, the guide shaft can be readily aligned with the guide hole.

It is preferable that the guide hole is disposed at a distal end thereof on a level with or inwardly of an opening end of the other of the male connector and the female connector.

It is preferable that the main portion includes a first portion and a second portion adjacent to the first portion and disposed remoter (more distant) than the first portion from a distal end of the main portion, the first portion being cylindrical, the second portion including a projection extending outwardly from a surface of the second portion, the female connector including a stopper making engagement with the projection to prevent the male connector from rotating about an axis thereof.

By designing the first portion to be cylindrical, it is possible to insert the main portion into the female connector with the main portion being rotated about an axis thereof, and by designing the second portion to include the projection, it is possible to prevent the male connector from rotating about an axis thereof when the projection makes engagement with the stopper of the female connector. Thus, it is possible to prevent the male and female connector from being forced to wear out or cause abrasion when they rotate to cause the male contact terminals and the female contact terminals to make frictional contact with each other, ensuring stable contact between the male and female contact terminals.

It is preferable that the projection is in the form of a gear.

It is preferable that the projection has a diameter smaller than the same of the first portion.

It is preferable that the guide shaft includes a first portion and a second portion adjacent to the first portion and disposed remoter (more distant) from a distal end of the guide shaft, the first portion being cylindrical, the second portion including a projection extending outwardly from a surface of the second portion, the guide hole being formed at an inner surface thereof with a groove making engagement with the projection to prevent the female connector from rotating about an axis thereof.

By designing the first portion to be cylindrical, it is possible to insert the guide shaft into the guide hall with the guide shaft being rotated about an axis thereof, and by designing the second portion to include the projection, it is possible to prevent the male connector from rotating about an axis thereof when the projection makes engagement with the groove of the guide hole. Thus, it is possible to prevent the male and female connector from being forced to wear out or cause abrasion when they rotate to cause the male contact terminals and the female contact terminals to make frictional contact with each other, ensuring stable contact between the male and female contact terminals.

It is preferable that the projection is in the form of a gear.

By designing the projection to be in the form of a gear, when the male connector is fit into the female connector, it is possible to engage the projection with the groove regardless of a rotational position of the male connector. Consequently, the male connector can take any rotational position when the male connector is fit into the female connector.

It is preferable that one of the male contact terminal and the female contact terminal is comprised of at least one cylindrical first terminal arranged coaxially with the guide shaft, and the other of the male contact terminal and the female contact terminal is comprised of a second terminal arranged in correspondence to the first terminal.

By designing one of the male contact terminal and the female contact terminal to be comprised of at least one cylindrical first terminal arranged coaxially with the guide shaft, and the other to be comprised of a second terminal arranged in correspondence to the first terminal, it is possible to keep the male and female contact terminals in contact with each other, even if the male or female connector axially rotates.

One of the male contact terminal and the female contact terminal may be comprised of a plurality of the first terminals, in which case, it is preferable that a first terminal disposed remoter (more distant) from a distal end of the guide shaft, having a smaller diameter.

By so designing the first terminals, the male connector can be fit into the female connector such that a first terminal does not make contact with second terminals other than a corresponding second terminal.

It is preferable that the second terminal includes a contact portion exposed outside for making contact with the first terminal, and a portion embedded in the other of the male contact terminal and the female contact terminal.

By designing the second terminal to include the contact portion and the embedded portion, it is possible to surely fix the second terminal, and enhance reliability to electrical connection between the first and second terminals. Furthermore, if the second terminal were deformed while being assembled, it would not be possible for the second terminal to be embedded into the connector. Thus, the deformed second terminal can be avoided from being used in wrong.

It is preferable that the stopper extends inwardly of a housing of the female connector from outside of the housing through an opening formed at a surface of the housing, to make engagement with the projection.

The advantages obtained by the aforementioned present invention will be described hereinbelow.

In the electric connector in accordance with the present invention, in the case that the male connector includes the guide shaft and the female connector includes the guide hole, since the guide shaft is inserted into the guide hole and is guided in a direction in which the male connector is fit into the female connector, it is possible to prevent the male connector from being inserted into the female connector with an axis thereof being inclined relative to an axis of the female connector. Thus, the electric connector in accordance with the present invention prevents the male connector from being obliquely inserted into the female connector, and thus, enhances electric connection between the male and female connectors.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

The electric connector in accordance with the first embodiment of the present invention will be explained hereinbelow with reference to the drawings.

In the specification, "front" or "distal" means a portion of a connector through which the connector is fit into a corresponding connector, and "rear" or "proximal" means an opposite portion of the connector.

The electric connector in accordance with the first embodiment is designed to include a male connector 10 and a female connector 20.

Figure 1:
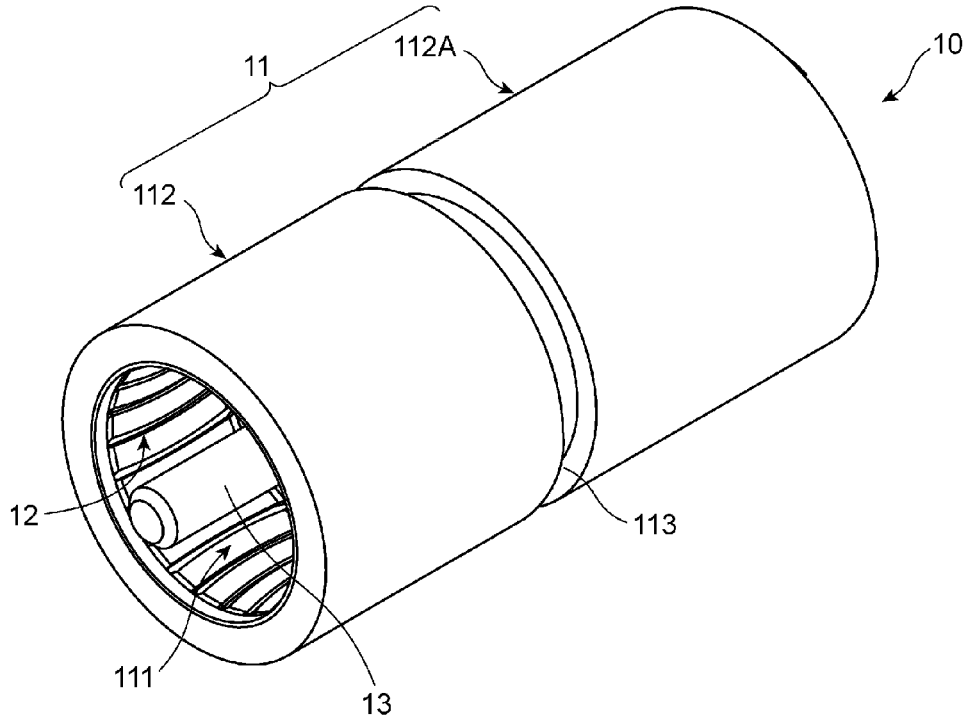
FIG. 1 is a perspective view of the male connector of the electric connector in accordance with the first embodiment of the present invention.
Figure 2:
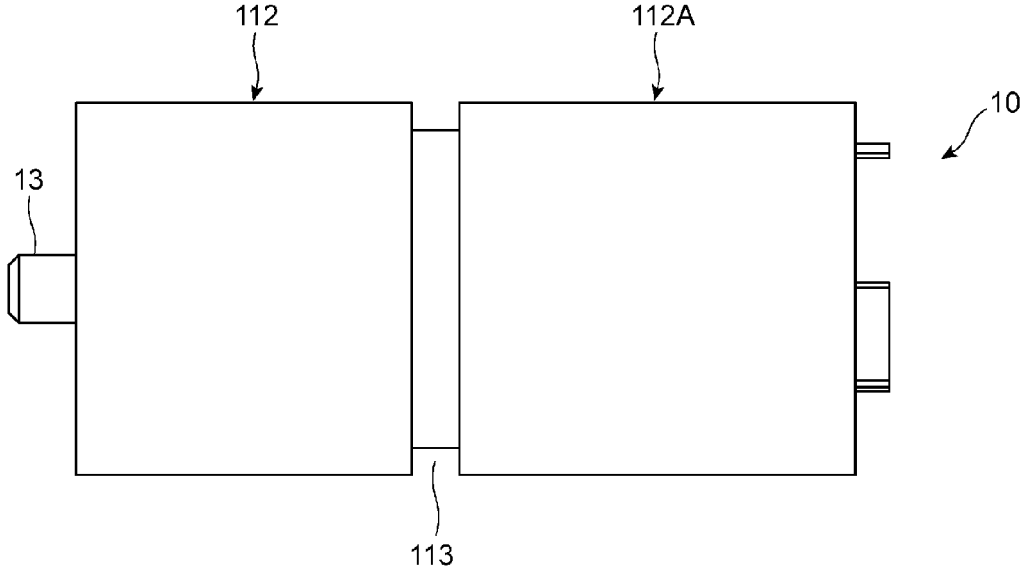
FIG. 2 is a side view of the male connector illustrated in FIG. 1.
Figure 3:
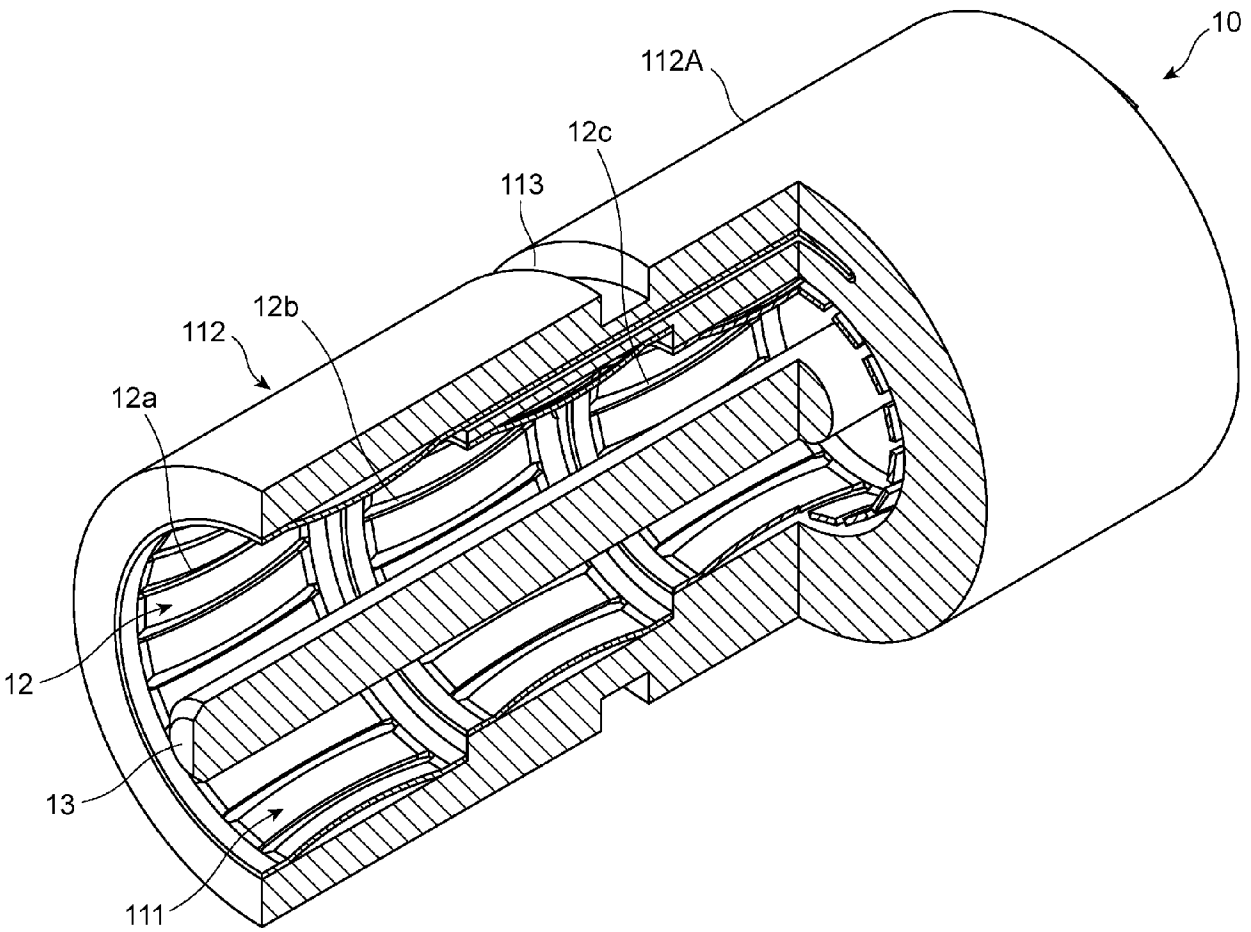
FIG. 3 is a perspective view of the male connector illustrated in FIG. 1 with a part thereof being removed.

The male connector 10 illustrated in FIGS. 1 to 3 includes a housing 11 as a main body of the connector, a male contact terminal 12 formed on an inner surface of the housing 11, and a guide shaft 13 formed in a hole 111 of the housing 11 and extending beyond an opening end of the housing 11 in a direction in which the male connector 10 is fit into the female connector 20.

The housing 11 is in the form of a cylinder having an opening end and a bottom. An inner surface of the housing 11 (that is, an inner surface of the hole 111) is designed to have a smaller diameter at a location closer to the bottom of the housing 11. Specifically, the housing 11 is designed to have three inner diameters different from one another.

The housing 11 is formed at an outer surface thereof with an annular groove 113 at a boundary between a first portion 112 and a second portion 112A both of which define the housing 11. The groove 113 makes engagement with an engagement projection of the female connector 20 to thereby prevent the male connector 10 and the female connector 20 from separating from each other.

Figure 4:
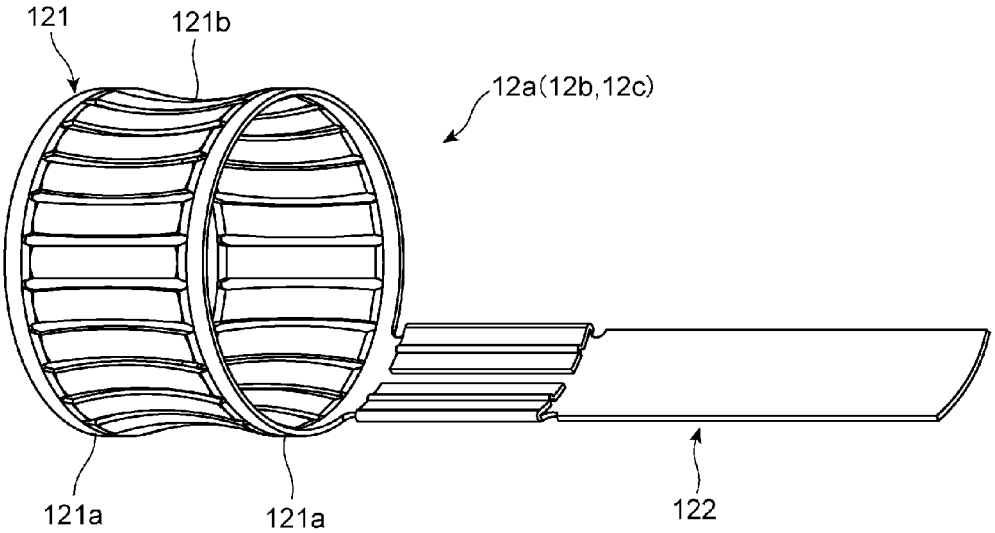
FIG. 4 is a perspective view of the male contact terminal equipped in the male connector illustrated in FIG. 3.
Figure 5:
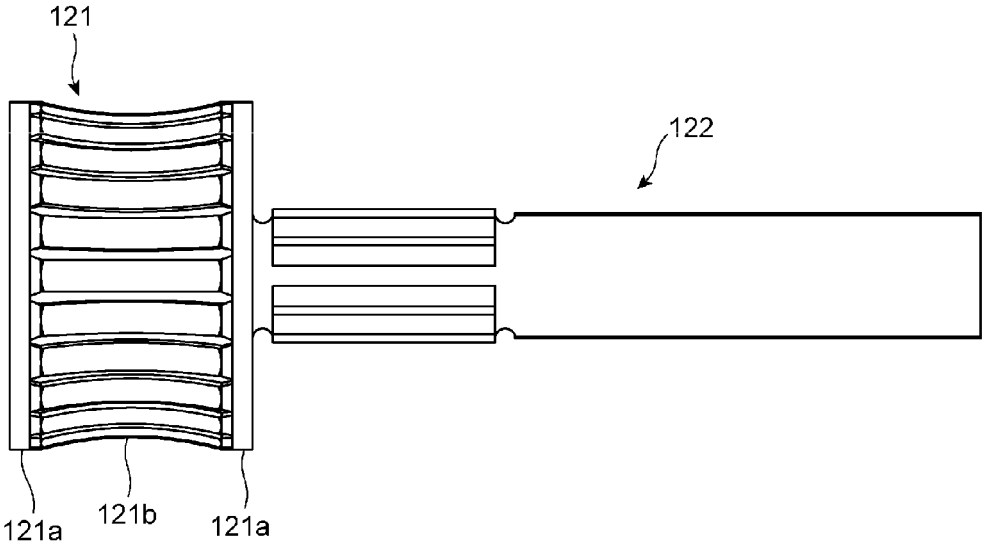
FIG. 5 is a side view of the male contact terminal illustrated in FIG. 4.
Figure 6:
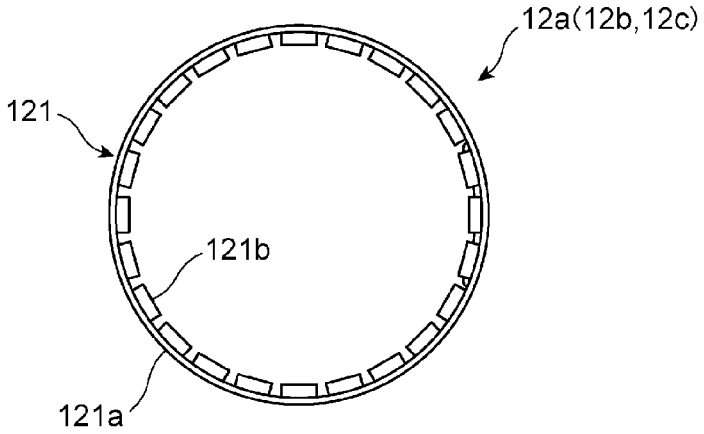
FIG. 6 is a front view of the male contact terminal illustrated in FIG. 4.
Figure 7:
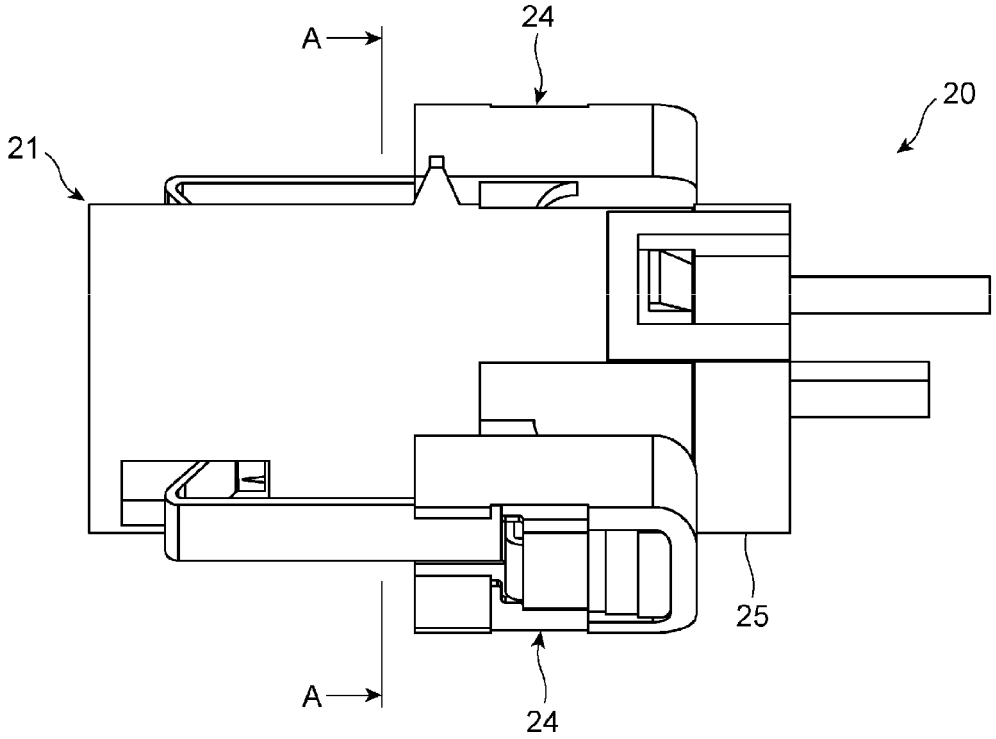
FIG. 7 is a side view of the female connector of the electric connector in accordance with the first embodiment of the present invention.
Figure 8:
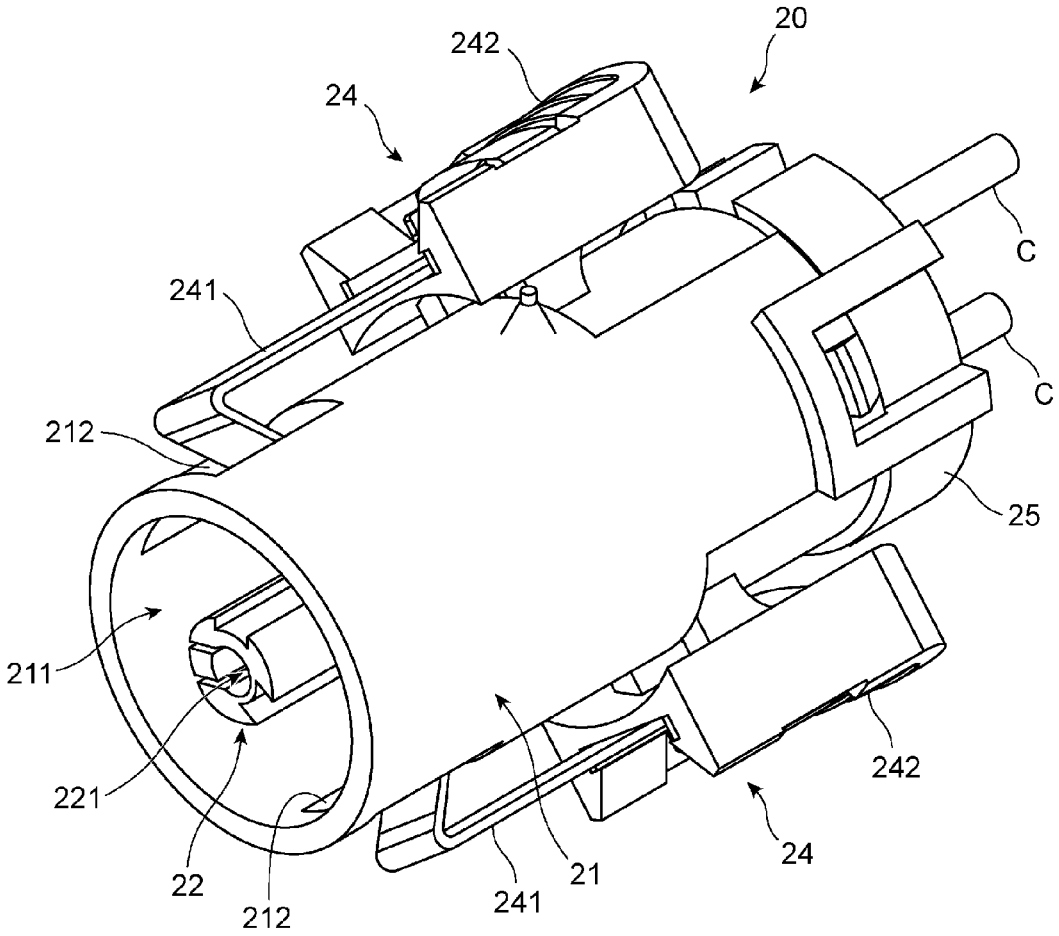
FIG. 8 is a perspective view of the female connector illustrated in FIG. 7.
Figure 9:
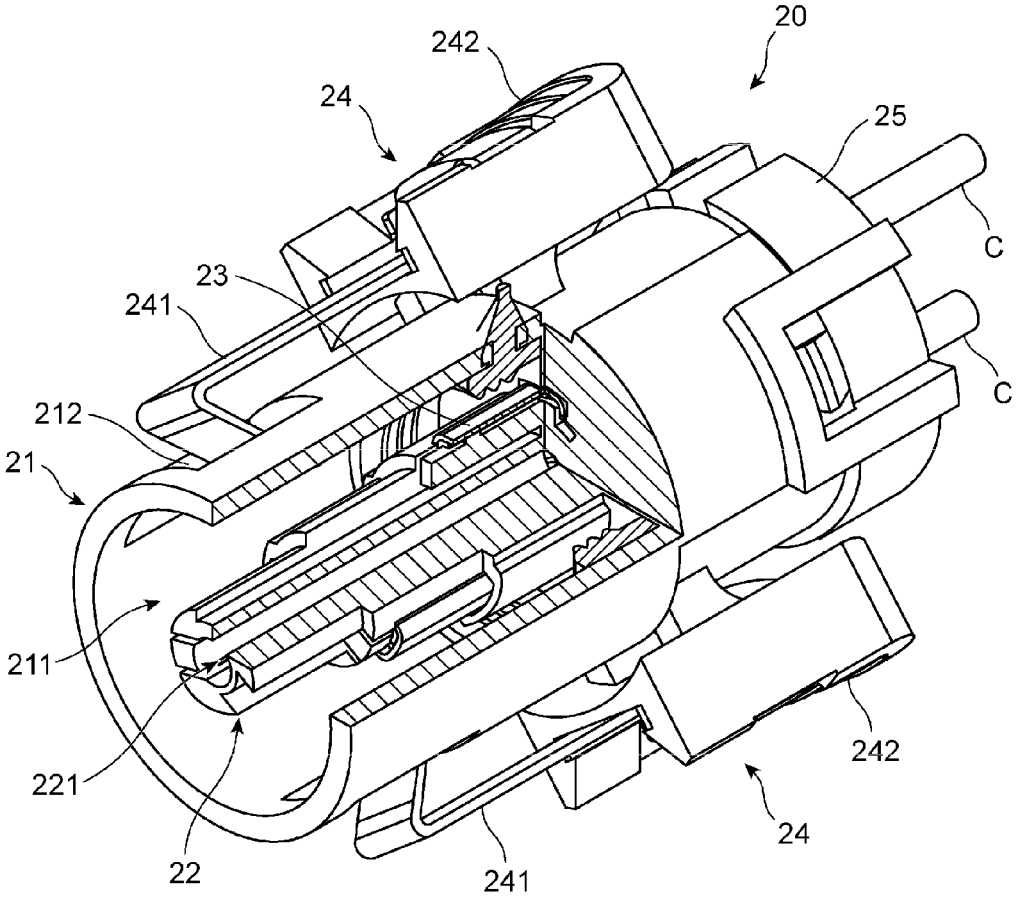
FIG. 9 is a perspective view of the female connector illustrated in FIG. 7 with a part thereof being removed.

The male contact terminal 12 is designed to include three terminals 12*a*, 12*b* and 12*c* having diameters different from one another in correspondence with the three inner diameters of the housing 11 (that is, the three inner diameters of the hole 111). Each of the terminals 12*a*, 12*b* and 12*c* is designed to include a terminal portion 121 in the form of a cylinder, and a connecting portion 122 connected to an end of the terminal portion 121, and further connected to another part (not illustrated), as illustrated in FIGS. 4 to 6.

The terminal portion 121 includes two rings 121*a*, and a plurality of resilient contacts 121*b*. The resilient contacts 121*b* extend between the rings 121*a*, and are equally spaced away from one another along a circumference of the rings 121*a*. The resilient contacts 121*b* define a circumferential plane in its entirety.

The connecting portion 122 has a proximal end through which the connecting portion 122 is connected to the terminal portion 121. The proximal end of the connecting portion 122 is folded in a width-wise direction to thereby have an increased thickness to be reinforced. The connecting portion 122 has a distal end extending beyond the housing 11 for electrically connecting to another part.

As illustrated in FIGS. 1 to 3, the guide shaft 13 extends along an axis of the first portion 112 of the housing 11 in a direction in which the male connector 10 is fit into the female connector 20, and further, extends beyond the housing 11 or an opening end of the first portion 112.

As illustrated in FIGS. 7 to 10, the female connector 20 includes a housing 21, a fitting shaft 22, a plurality of female contact terminals 23, two engagement sections 24, and a rear cover 25.

The housing 21 is in the form of a cylinder opening at a distal end thereof and having a bottom at a proximal end thereof. The housing 21 is formed with a hole 211 having a circular cross-section, into which the cylindrical first portion 112 of the male connector 10 is inserted.

The fitting shaft 22 extends along an axis of the hole 211, and is formed with a guide hole 221 having a circular cross-section for allowing the guide shaft 13 to be inserted therein to thereby guide the guide shaft 13 in a direction in which the male connector 10 is fit into the female connector 20. The fitting shaft 22 has a distal end disposed on a level with an opening end of the hole 211 of the housing 21.

The fitting shaft 22 is designed to have a diameter gradually greater at a position closer to a bottom of the housing 21. Specifically, the fitting shaft 22 is comprised of three sections. The section disposed closer to a bottom of the housing 21 is designed to have a greater diameter in corresponding with inner diameters of the male contact terminals 12*a* to 12*c*.

Figure 10:
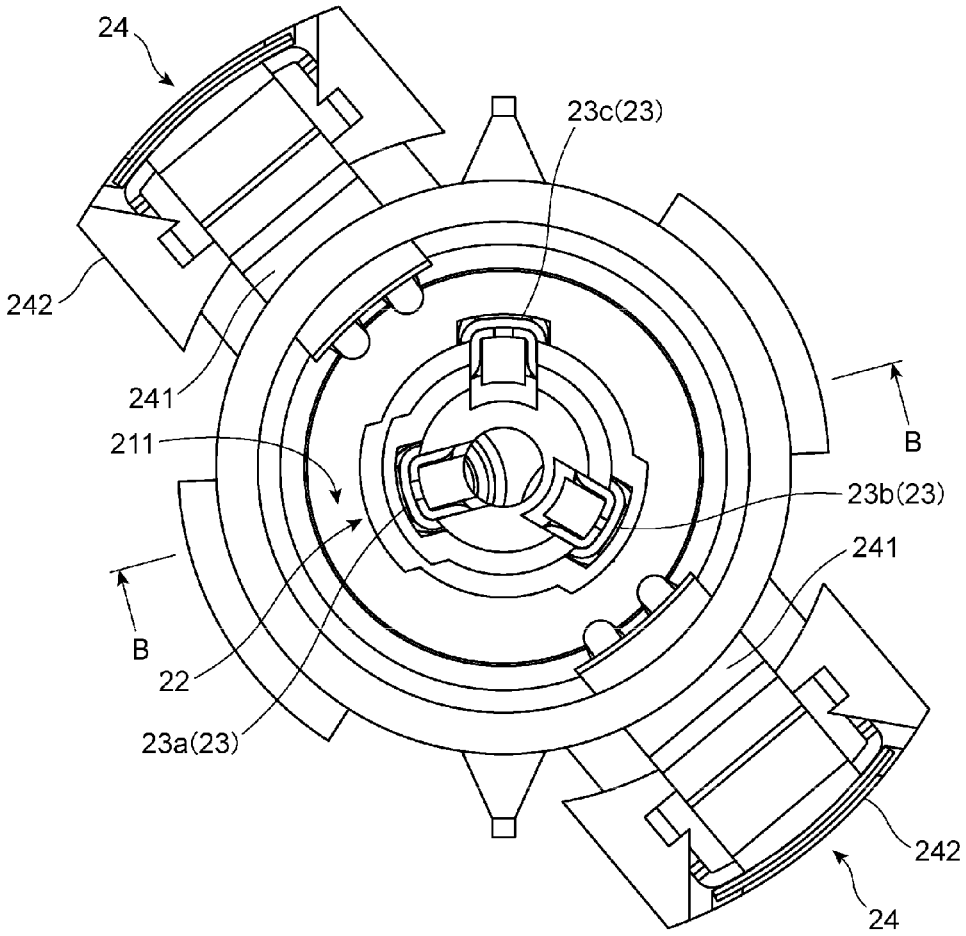
FIG. 10 is a front view of the female contact terminal illustrated in FIG. 7.

The female contact terminal 23 includes three terminals 23*a*, 23*b* and 23*c*. Each of the female contact terminals 23*a*, 23*b* and 23*c* is comprised of a linear terminal making contact with the male contact terminal 12*a*, 12*b* and 12*c*. Each of the female contact terminals 23*a*, 23*b* and 23*c* is disposed on an outer surface of the fitting shaft 22 at a different angle from one another about an axis of the fitting shaft 22. Specifically, as illustrated in FIG. 10, the female contact terminals 23*a*, 23*b* and 23*c* are disposed on outer surfaces of the three sections of the fitting shaft 22 at about 120 circumference angles about an axis of the fitting shaft 22. Thus, the female contact terminals 23*a*, 23*b* and 23*c* disposed at different circumference angles are able to make contact with the male contact terminals 12*a*, 12*b* and 12*c*, respectively.

The female contact terminals 23*a*, 23*b* and 23*c* are inserted into the housing 21 through a rear of the housing 21 after the rear cover 25 is removed out of the housing 21.

Figure 11:
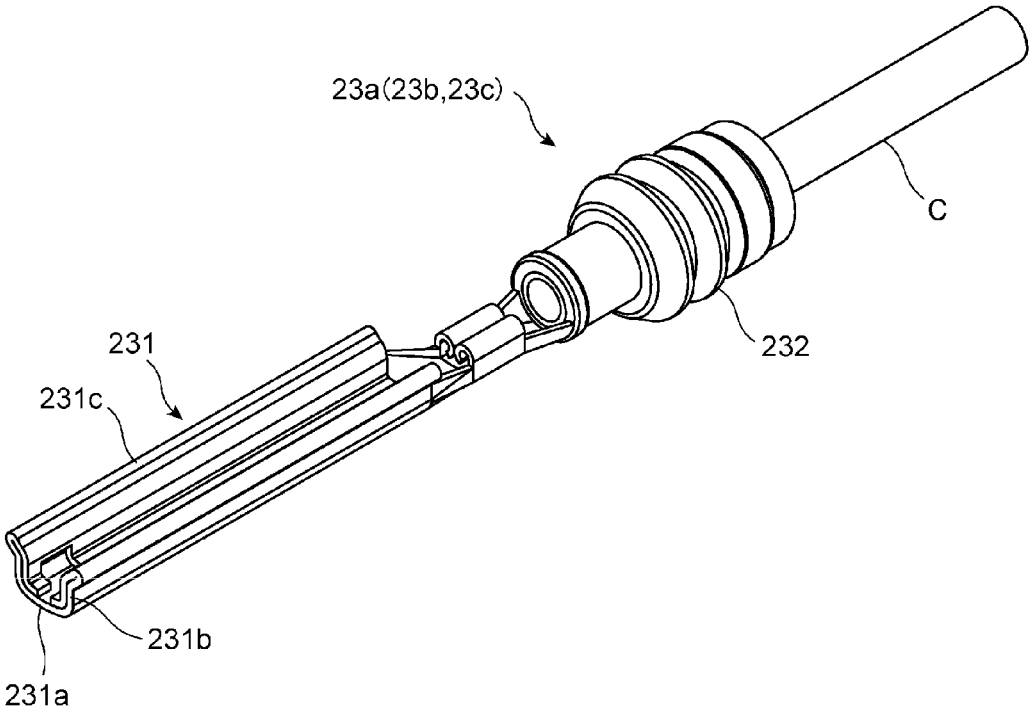
FIG. 11 is a perspective view of the female contact terminal equipped in the female connector illustrated in FIG. 9.
Figure 12:
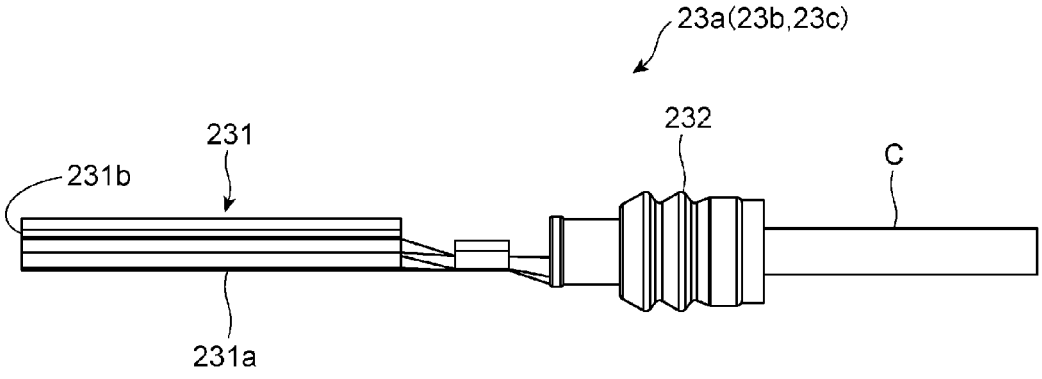
FIG. 12 is a side view of the female contact terminal illustrated in FIG. 11.
Figure 13:
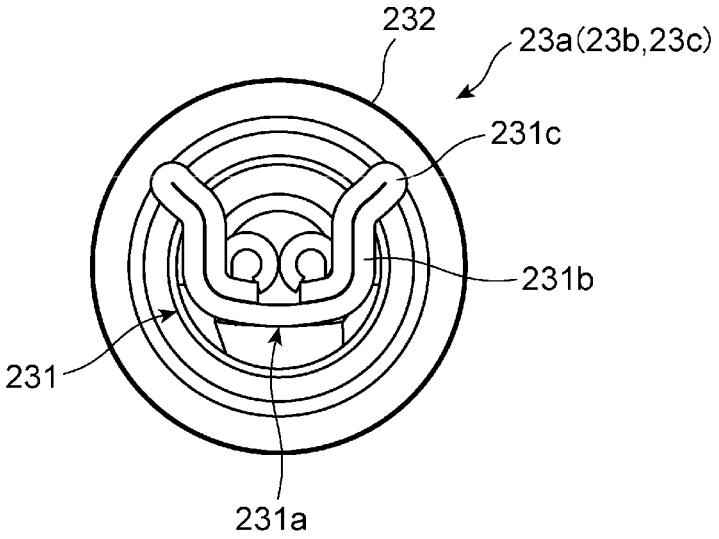
FIG. 13 is a front view of the female contact terminal illustrated in FIG. 11.

As illustrated in FIGS. 11 to 13, each of the female contact terminals 23*a*, 23*b* and 23*c* includes a terminal portion 231 and a packing portion 232. The terminal portion 231 is comprised of a plate folded at opposite sides to thereby have an increased thickness in order to be reinforced. The packing portion 232 fills a space formed between a cable C connected to the terminal portion 231 and the housing 21 to thereby prevent moisture from penetrating the housing 21.

Figure 17:
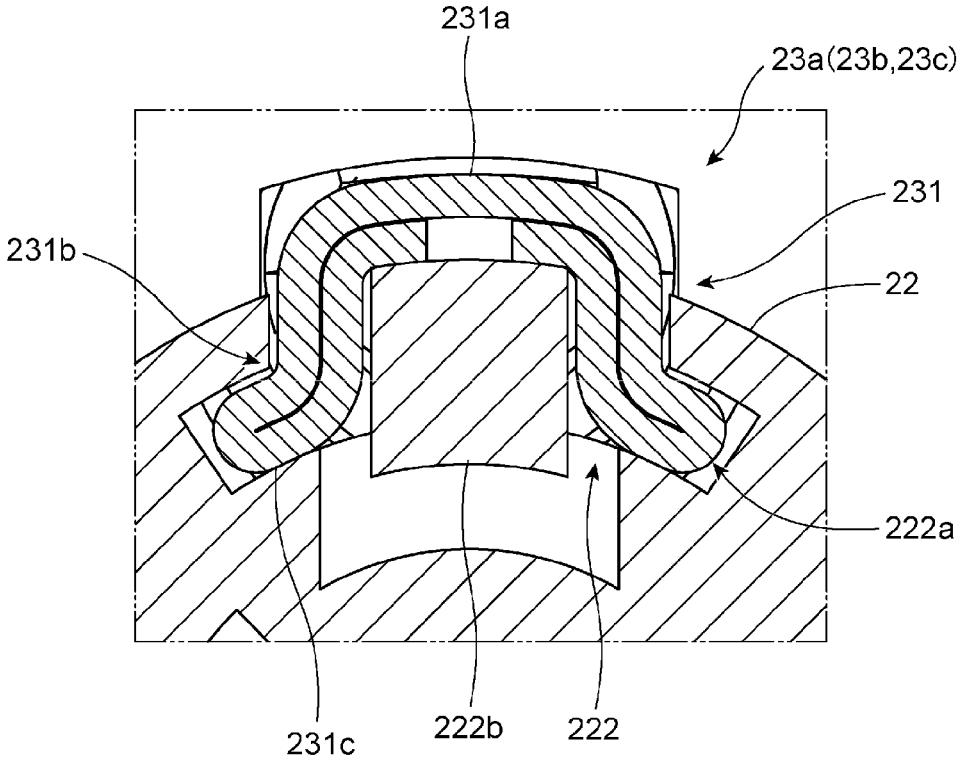
FIG. 17 is an enlarged view of the portion C shown in FIG. 16.

The terminal portion 231 has an almost C-shaped cross-section. As illustrated in FIG. 17, the terminal portion 231 includes a contact portion 231*a* exposed outside of the fitting shaft 22 to make contact with the male contact terminal 12*a*, 12*b* or 12*c*, and an embedded portion 231*b* embedded into the fitting shaft 22. The embedded portion 231*b* is outwardly bent at a distal end thereof to thereby define a curved portion 231*c*.

The fitting shaft 22 is formed with recesses 222 in which the male contact terminal 12*a*, 12*b* or 12*c* are housed. Each of the recesses 222 includes a guide groove 222*a* extending along an axis of the fitting shaft 22 for guiding the curved portion 231*c*. In the recess 222 is formed a support piece 222*b* for guiding the male contact terminals 12*a*, 12*b* and 12*c* into the recess 222, and further for supporting the contact portion 231*a* at a rear to thereby cause the contact portion 231*a* to protrude beyond an outer surface of the fitting shaft 22, and maintain resiliency of the contact portion 231*a* making contact with the male contact terminal 12*a*, 12*b* or 12*c*.

As illustrated in FIGS. 7 to 10, the two engagement sections 24 are disposed in facing relation around an axis of the housing 21 at a bottom of the housing 21. Each of the engagement sections 24 includes an engagement hook 241 through which the engagement section 24 makes engagement with the male connector 10, and a fixing unit 242 for fixing the engagement hook 241 to the housing 21.

The engagement hook 241 is substantially J-shaped, and passes at a distal end thereof through an engagement opening 212 of the housing 21.

The rear cover 25 covers a rear of the housing 21 therewith. The rear cover 25 is attached to a bottom of the housing 21 to thereby hold the packing portion 232 for preventing the cable C from being released out of the female contact terminals 23*a*, 23*b* or 23*c*.

The electric connector in accordance with the first embodiment of the present invention, having the above-mentioned structure, is used as follows.

Figure 14:
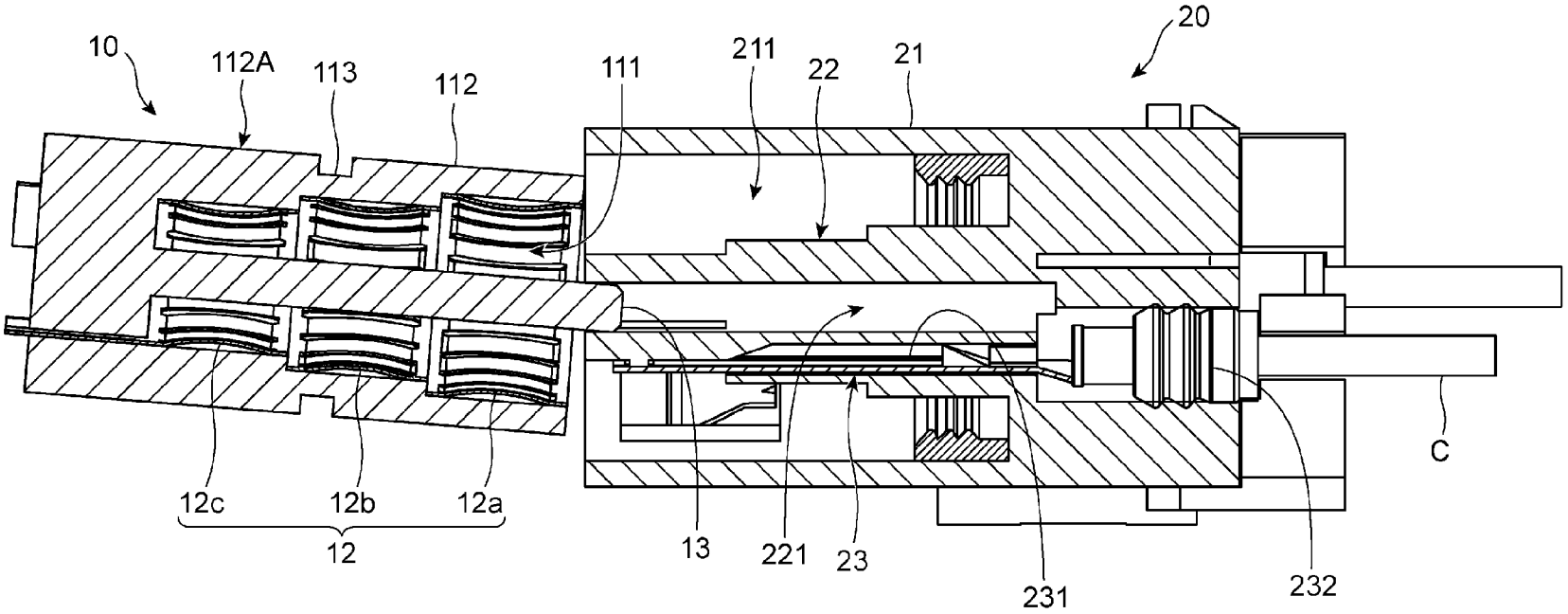
FIG. 14 is a cross-sectional view of the male and female connectors not being fit into each other, including a cross-sectional view taken along the line B-B shown in FIG. 10.

As illustrated in FIG. 14, the guide shaft 13 of the male connector 10 is aligned with the fitting shaft 22 of the female connector 20. Since the guide shaft 13 is designed to extend outwardly beyond an opening end of the housing 11, the guide shaft 13 can be readily aligned with the guide hole 221 of the fitting shaft 22. Furthermore, since the fitting shaft 22 is on a level at a distal end thereof with an opening end of the guide hole 221 of the housing 21, the guide hole 221 of the fitting shaft 22 into which the guide shaft 13 is to be inserted can be readily recognized, and, even if the guide hole 221 is not recognized, it is easy to insert the guide shaft 13 into the guide hole 221.

Even if an axis of the male connector 10 inclines relative to an axis of the female connector 20, after the guide shaft 13 was inserted at a distal end thereof into the guide hole 221 of the fitting shaft 22, the guide shaft 13 can be forwarded in the guide hole 221 of the fitting shaft 22 as the male connector 10 continues to be inserted into the guide hole 221.

Figure 15:
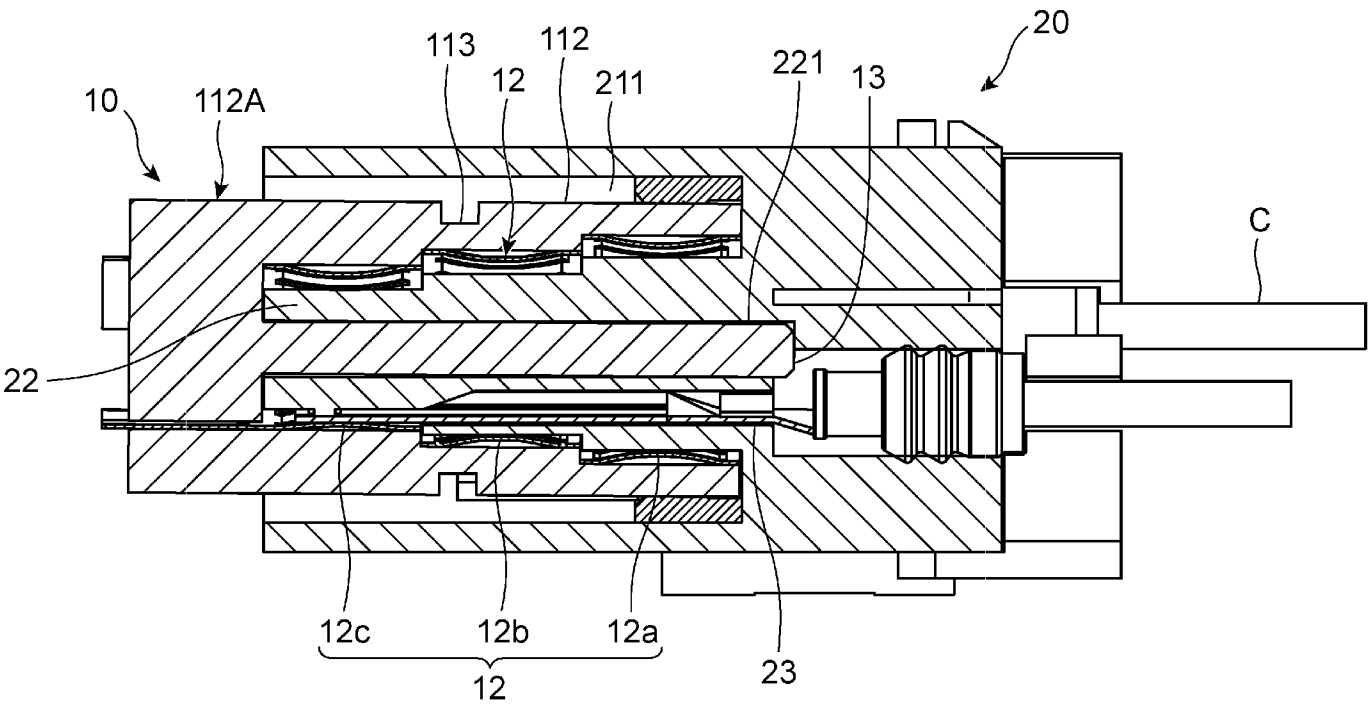
FIG. 15 is a cross-sectional view of the male and female connectors being fit into each other.
Figure 16:
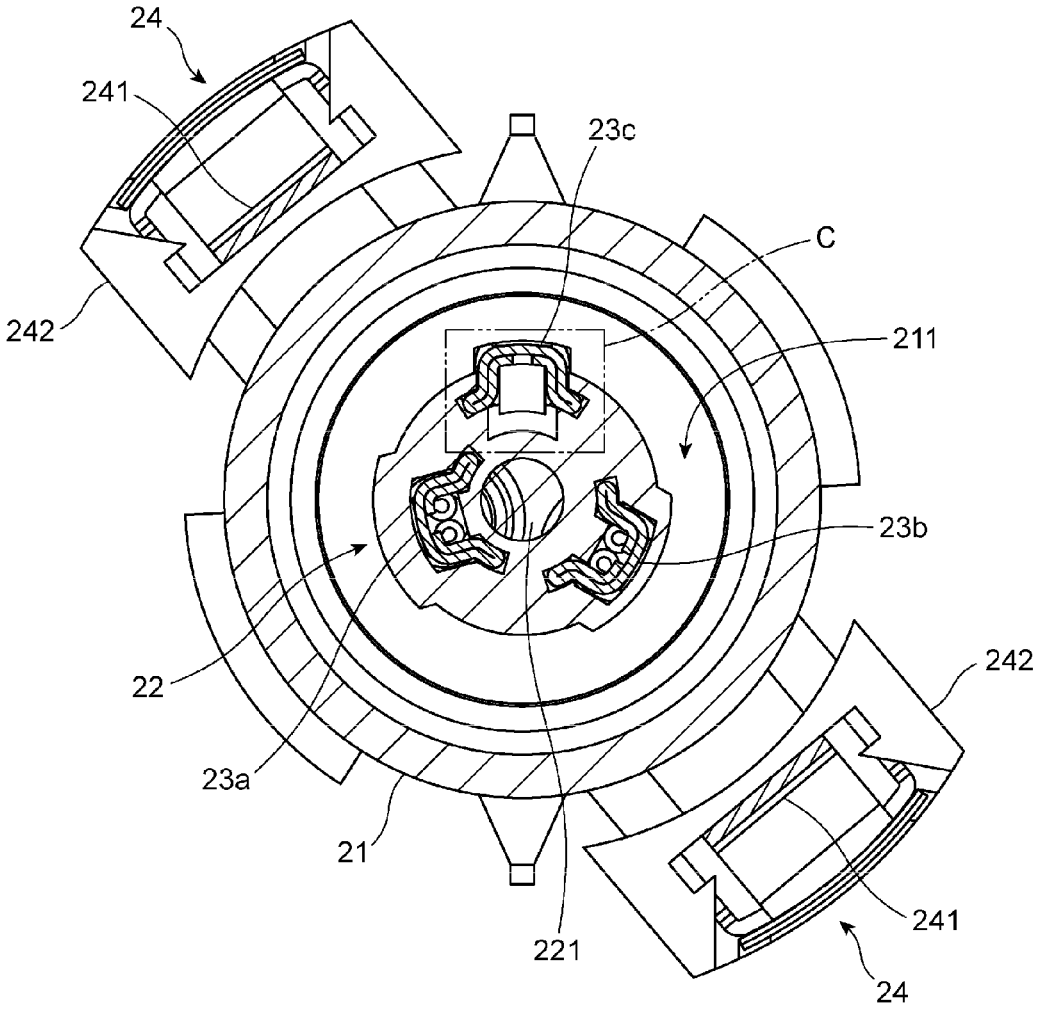
FIG. 16 is a cross-sectional view taken along the line A-A shown in FIG. 7.

As illustrated in FIG. 15, since the guide shaft 13 moves forwardly in the guide hole 221, the first portion 112 of the male connector 10 is inserted into the hole 211 of the female connector 20 with the axes of the male connector 10 and the female connector 20 being coincidental with each other. In addition, the fitting shaft 22 of the female connector 20 is inserted into the hole 111 of the male connector 10 with the axes of the male connector 10 and the female connector 20 being coincidental with each other.

The fitting shaft 22 is designed to include three sections, in which the section disposed closer to a bottom of the housing 21 has a greater diameter, and the hole 111 of the male connector 10 is designed to include the three sections, in which the section disposed closer to a bottom of the housing 11 has a smaller diameter, as illustrated in FIG. 14. Accordingly, the first portion 112 of the male connector 10 is inserted into the hole 211, keeping a constant space between the female contact terminals 23*a* to 23*c* formed on an outer surface of the fitting shaft 22 and the male contact terminals 12*a* to 12*c* formed on an inner surface of the hole 111. Thus, the male connector 10 can be inserted into the female connector 20 such that each of the male contact terminals 12*a* to 12*c* does not make contact with the female contact terminals 23*a* to 23*c* other than a corresponding female contact terminal 23*a*, 23*b* or 23*c*.

Thus, when the male connector 10 is fully inserted into the female connector 20, each of the male contact terminals 12*a* to 12*c* makes contact only with the corresponding female contact terminals 23*a* to 23*c*, respectively.

When the first portion 112 of the housing 11 is fully inserted into the hole 211, the engagement hooks 241 of the engagement sections 24 (see FIG. 9) make engagement with the annular groove 113 of the housing 11 (see FIG. 15), and thus, the male connector 10 is firmly fit into the female connector 20.

As mentioned above, even if the male connector 10 is inserted into the female connector 20 with an axis of the male connector 10 being inclined relative to an axis of the female connector 20, the male connector 10 is corrected with respect to its position, and thus, the male connector 10 can be inserted into the female connector 20 with the axes of the male connector and the female connector 20 being aligned with each other. Thus, it is possible to prevent to insert the male connector 10 into the female connector 20 with an axis of the male connector 10 being inclined relative to an axis of the female connector 20, and to obliquely insert the male connector 10 into the female connector 20. Consequently, the male connector 10 and the female connector 20 can be fit into each other without the male contact terminals 12*a* to 12*c* and/or the female contact terminals 23*a* to 23*c* being damaged, ensuring reliability to electrical connection between the male connector 10 and the female connector 20.

Since the first portion 112 of the housing 11 is cylindrical, the male connector 10 can be inserted into the female connector 20, even if the male connector 10 is rotated about an axis thereof while the male connector is being inserted into the female connector 20, ensuring reduction in time necessary for inserting the male connector 10 into the female connector 20. Furthermore, the male contact terminals 12*a* to 12*c* are cylindrical and coaxial with the guide shaft 13, and the female contact terminals 23*a* to 23*c* are arranged around the fitting shaft 22 in correspondence with the male contact terminals 12*a* to 12*c*. Thus, even if the male connector 10 or the female connector 20 rotates about an axis thereof, the male connector 10 and the female connector 20 can keep in contact with each other.

In the terminal portion 231 of the female contact terminal 23 illustrated in FIG. 17, the embedded portion 231*b* is outwardly bent at opposite ends thereof to thereby define the curved portions 231*c*, which are inserted into the housing 21 through the guide groove 222*a* of the hole 222, ensuring that the female contact terminals 23*a* to 23*c* are surely fixed to the housing 21 to thereby enhance reliability to electrical contact between the female contact terminals 23*a* to 23*c* and the male contact terminals 12*a* to 12*c*. Furthermore, since the curved portions 231*c* are inserted into the housing 21 through the guide groove 222*a* of the hole 222, if the terminal portion 231 were deformed when the female contact terminals 23*a* to 23*c* are connected to the cable C, the curve portions 231*c* could not be inserted into the guide groove 222*a*. Accordingly, it is possible to prevent the deformed terminal portion 231 from being used by mistake, ensuring that non-deformed female contact terminals 23*a* to 23*c* can be separated from deformed female contact terminals 23*a* to 23*c*, and only non-deformed female contact terminals 23*a* to 23*c* can be inserted into the housing 21. Accordingly, it is possible to enhance reliability to electrical contact between the female contact terminals 23*a* to 23*c* and the male contact terminals 12*a* to 12*c*.

It should be noted that though each of the embedded portions 231*b* of the female contact terminals 23*a* to 23*c* is designed to include the curved portions 231*c* in the first embodiment, the female contact terminals 23*a* to 23*c* may be designed not to include the curved portions 231*c*, if the female contact terminals 23*a* to 23*c* can be fixed to the fitting shaft 22 through another part. Furthermore, the curved portions 231*c* are outwardly open far away from each other. One of the curved portions 231*c* may be outwardly open, or one or both of the curved portions 231*c* may be bent so as to be closed to each other.

Second Embodiment

The electric connector in accordance with the second embodiment of the present invention is explained hereinbelow with reference to the drawings. Parts or elements in FIGS. 18 to 20 that correspond to those of the first embodiment illustrated in FIGS. 1 to 17 have been provided with the same reference numerals, and are not explained.

As detailed later, the electric connector in accordance with the second embodiment is characterized in that a male connector 10X is designed to include projections 116, and a female connector 20X is designed to include an engagement section 24X making engagement with the projections 116 to thereby prevent the male connector 10X from rotating about an axis thereof.

Figure 18:
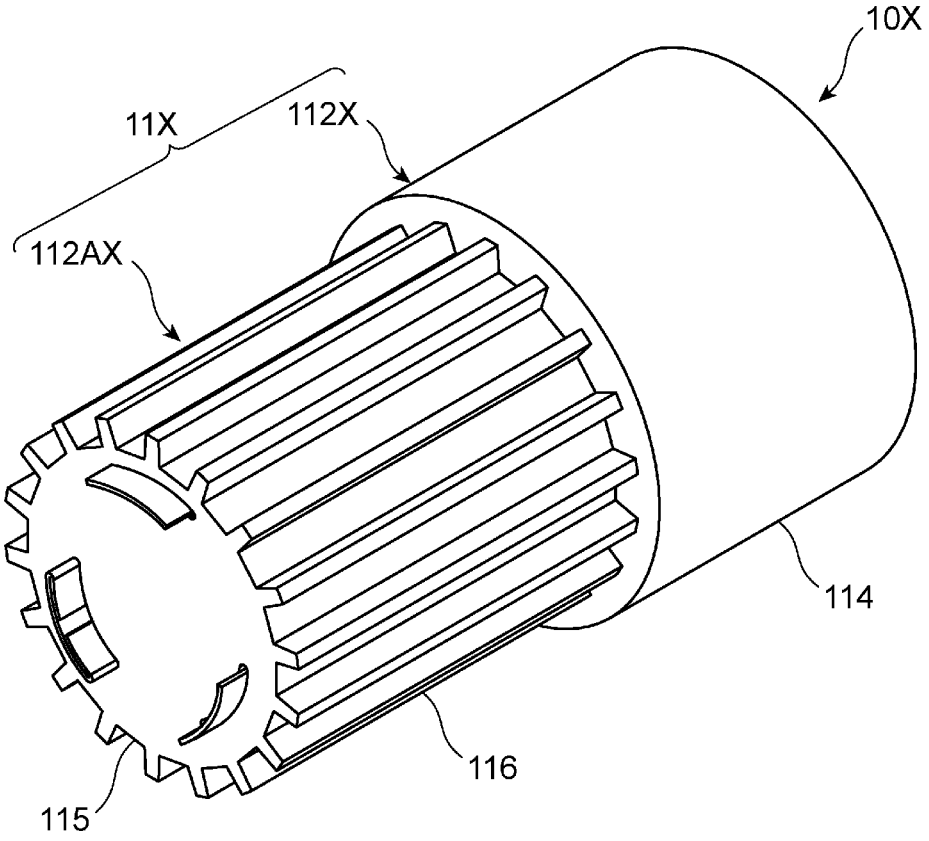
FIG. 18 is a perspective view of the male connector of the electric connector in accordance with the second embodiment of the present invention.

As illustrated in FIG. 18, the male connector 10X in the second embodiment is designed to include a housing 11X having a first portion 112X and a second portion 112AX adjacent to the first portion 112X. The first portion 112X has a circular cross-section, and has a cylindrical outer surface 114. The guide shaft 13 extends in the first portion 112X, similarly to the first portion 112 of the housing 11 (see FIG. 1) in the first embodiment. A plurality of linear projections 116 extending in a direction in which the male connector 10X is inserted into the female connector 20X are formed on an outer surface 115 of the second portion 112AX. The projections 116 are equally spaced apart from adjacent ones (each other) on the outer surface 115 of the second portion 112AX. The projections 116 are in the form of a gear. The projections 116 are designed to have a common diameter smaller than a diameter of the first portion 112X.

Figure 19:
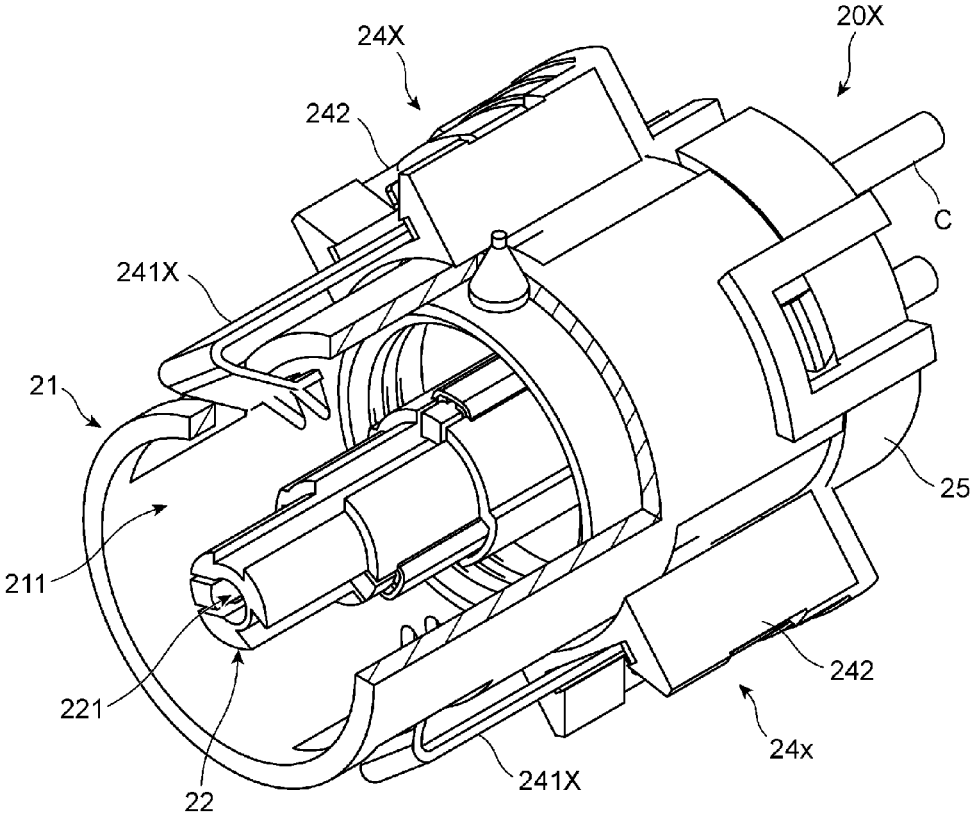
FIG. 19 is a perspective view of the male connector of the electric connector in accordance with the second embodiment of the present invention with a part thereof being removed.
Figure 20:
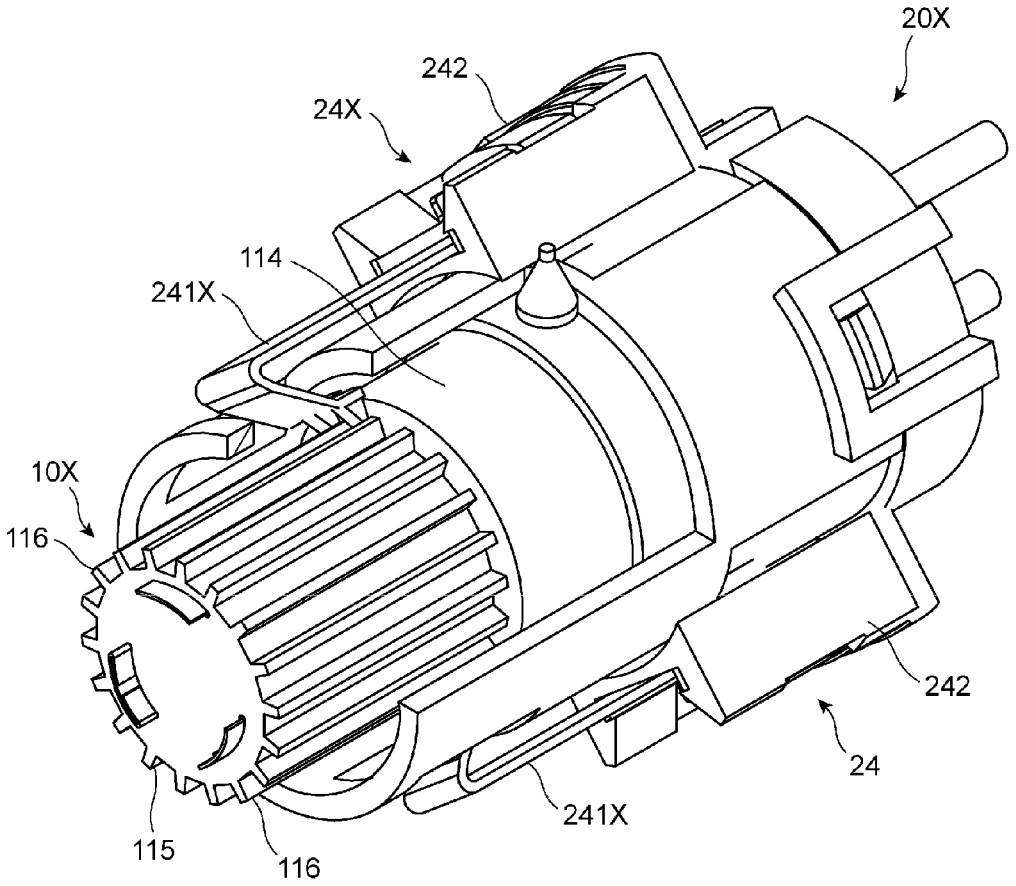
FIG. 20 is a perspective view of the male connector illustrated in FIG. 18 and the female connector illustrated in FIG. 19, being fit into each other.

As illustrated in FIGS. 19 and 20, each of the engagement sections 24X includes an engagement hook (stopper) 241X through which the engagement section 24X makes engagement with the male connector 10X, and a fixing unit 242 for fixing the engagement hook 241X to the housing 21. As shown in FIGS. 19 and 20, the engagement hook (stopper) 241X extends inwardly through an opening in the housing 21 of the female connector 20X to engage the projections 116. The engagement hook (stopper) 241X is substantially J-shaped similarly to the engagement hook 241 (see FIGS. 8 and 9) in the first embodiment, but different in structure from the engagement hook 241 in that the engagement hook 241X is bifurcated at a distal end thereof, and thus, is able to sandwich or make engagement with each of the projections 116 to thereby prevent the male connector 10X from rotating about an axis thereof. The engagement hook 241X is not to be limited in structure to a hook having a bifurcated end. For instance, the engagement hook (stopper) 241X may be designed to have a tapered distal end, in which case, the engagement hook 214X makes engagement with a space formed between adjacent projections 116 to thereby prevent the male connector 10X from rotating about an axis thereof.

The number of the projections 116 can be determined based on the number of engagement sections 24X, if the projections 116 can make engagement with the two engagement sections 24X. Since a plurality of the projections 116 is formed like a gear circumferentially around the housing 11X at a predetermined pitch, any one of the projections 116 can be caused to make engagement with the engagement sections 24X when the male connector 10X is fit into the female connector 20X regardless of a rotational position of the male connector 10X. Furthermore, since the projections 116 are designed to have a diameter smaller than that of the first portion 112X, the engagement hooks (stoppers) 241X of the engagement sections 24X drop onto the projections 116 from the outer surface 114 of the first portion 112X to thereby allow the male connector 10X to be fit into the female connector 20X, when the male connector 10X is fit into the female connector 20X, and further, the engagement hooks 241X prevent the male connector 10X from being released out of the female connector 20X. Even if the engagement hook 241X rides on one of the projections 116, and thus, fails to make engagement with the projections 116, the engagement hook 241X is able to grasp one of the projections 116 after the male connector 10X or the female connector 20X rotated, and further, prevent the male connector 10X or the female connector 20X from further rotating. Thus, the male connector 10X can be fit into the female connector 20X regardless of a rotational position of the male connector 10X.

As mentioned above, since the male connector 10X does not rotate when the male connector 10X is fit into the female connector 20X, it is possible to prevent the male contact terminals 12*a* to 12*c* and the female contact terminals 23*a* to 23*c* from making frictional contact with each other to thereby be forced worn out or abrasive due to the rotation of the male connector 10X and the female connector 20X, ensuring that the male contact terminals 12*a* to 12*c* and the female contact terminals 23*a* to 23*c* can stably keep in contact with each other.

Furthermore, since the first portion 112X is designed to have the circumferential surface 114, the male connector 10X can be fit into the female connector 20X with the male connector 10X being rotated about an axis thereof, ensuring reduction in time necessary for fitting the male connector 10X into the female connector 20X.

Third Embodiment

The electric connector in accordance with the third embodiment of the present invention is explained hereinbelow with reference to the drawings. Parts or elements in FIGS. 21 and 22 that correspond to those of the first and second embodiments illustrated in FIGS. 1 to 20 have been provided with the same reference numerals, and are not explained.

As mentioned later in detail, the male connector in the third embodiment is characterized in that the guide shaft is designed to include a first cylindrical portion and a second portion including a plurality of projections, and the guide hole is formed at an inner surface thereof with grooves making engagement with the projections to thereby prevent the male connector from rotating about an axis thereof.

Figure 21:
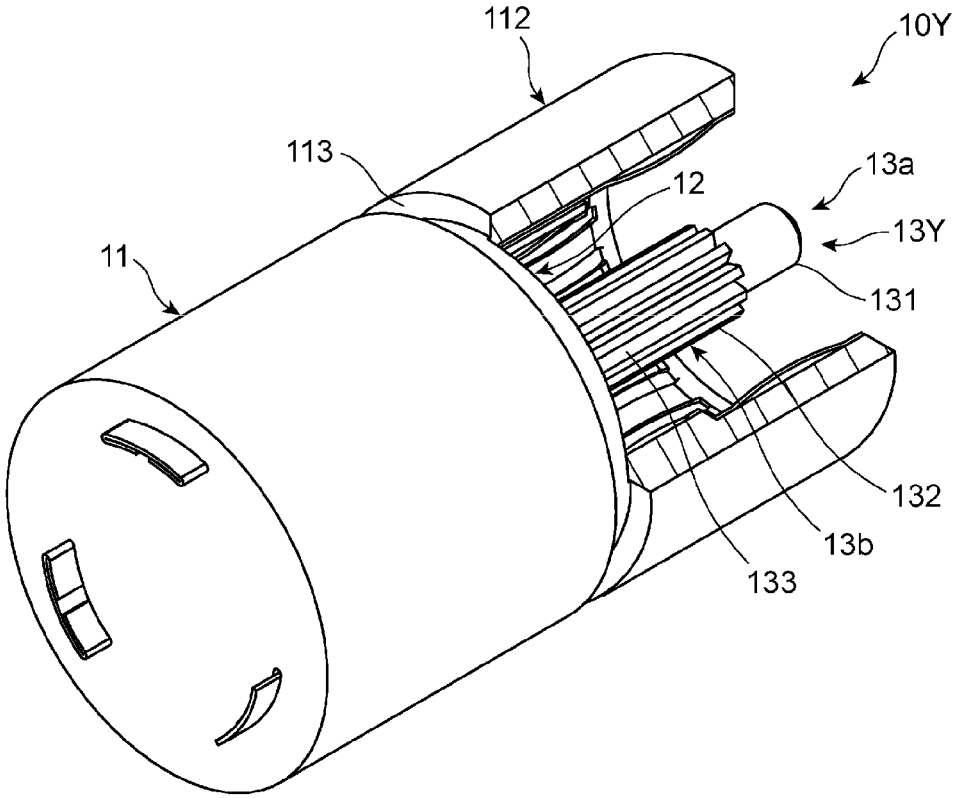
FIG. 21 is a perspective view of the male connector of the electric connector in accordance with the third embodiment of the present invention with a part thereof being removed.

As illustrated in FIG. 21, a male connector 10Y in the third embodiment includes a guide shaft 13Y. The guide shaft 13Y is designed to include a first portion 13*a* and a second portion 13*b*. The first portion 13*a* has a circular cross-section, and hence, has a cylindrical surface 131. The second portion 13*b* has a plurality of linear projections 132 extending in a direction in which the male connector 10Y is fit into a female connector 20Y. The linear projections 132 are spaced away from one another on a cylindrical surface 133 of the second portion 13*b*, and hence, are in the form of a gear.

Figure 22:
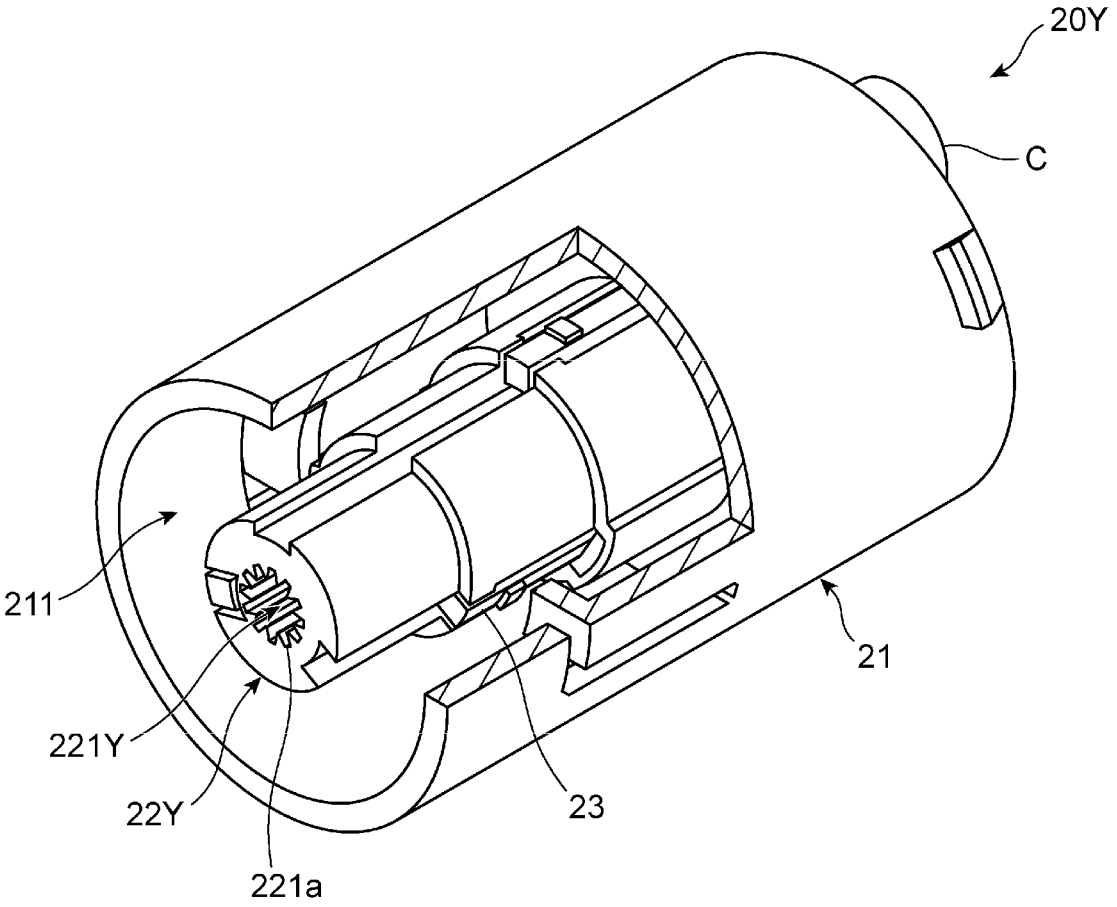
FIG. 22 is a perspective view of the female connector of the electric connector in accordance with the third embodiment of the present invention with a part thereof being removed.
Figure 23:
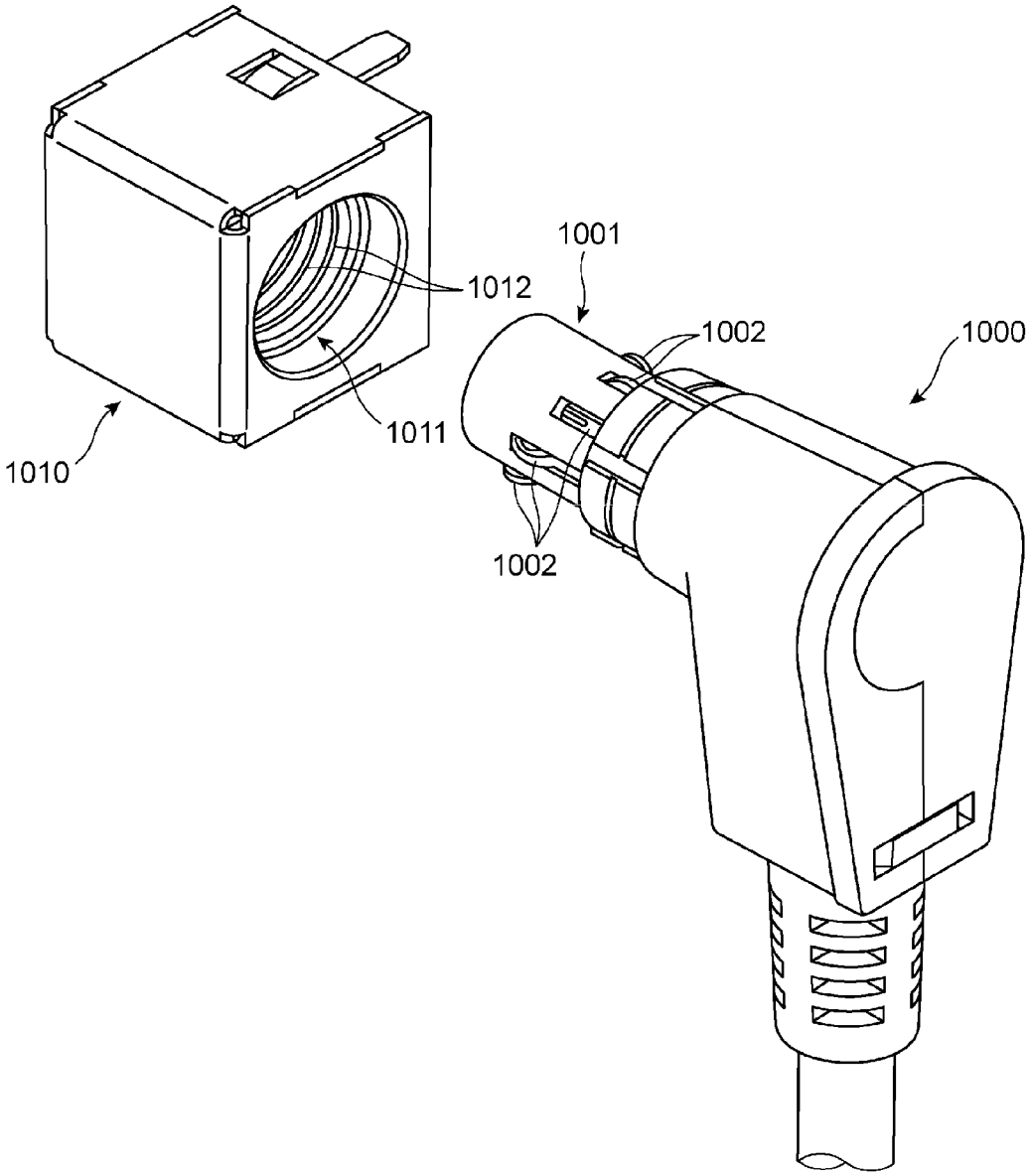
FIG. 23 is a perspective view of the conventional connectors.
Figure 24A:
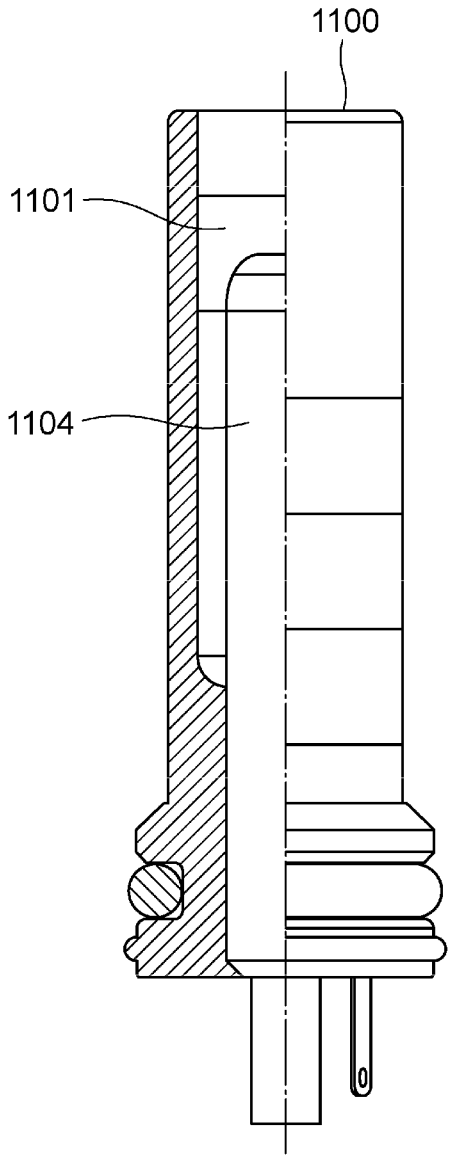
FIG. 24A is a cross-sectional view of the conventional glow plug.
Figure 24B:
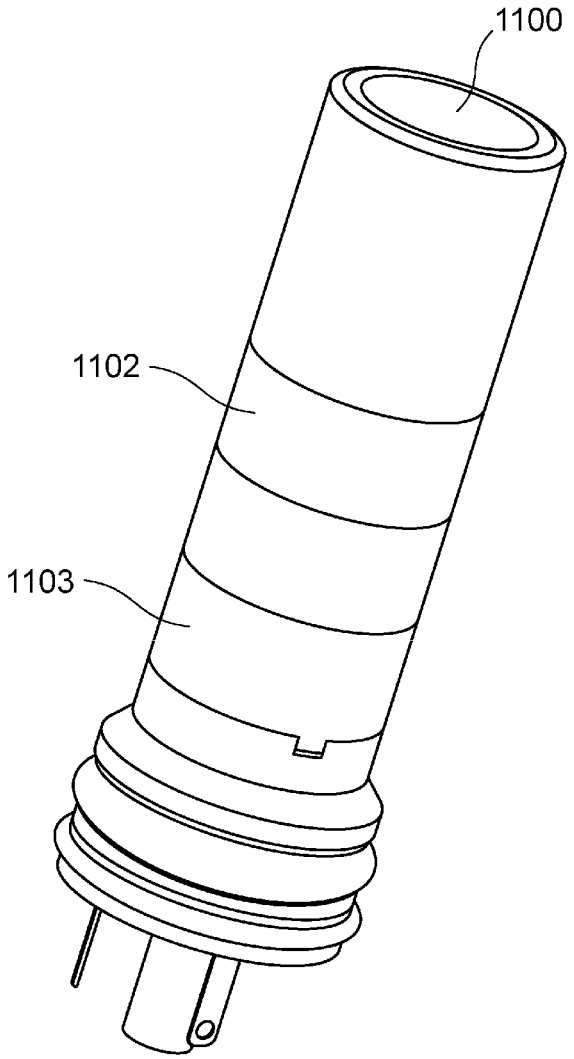
FIG. 24B is a perspective view of the glow plug illustrated in FIG. 24A.

As illustrated in FIG. 22, the female connector 20Y has a fitting shaft 22Y in which a guide hole 221Y is formed. The guide hole 221Y is radially formed at an inner surface thereof with grooves 221*a* into which the projections 132 of the guide shaft 13Y are inserted. The grooves 221*a* extend in a direction in which the male connector 10Y is fit into a female connector 20Y.

When the guide shaft 13Y of the male connector 10Y is inserted into the guide hole 221Y of the fitting shaft 22Y, the cylindrical surface 131 of the guide shaft 13 is first inserted into the guide hole 221Y. However, since the cylindrical surface 131 cannot be inserted into the grooves 221*a*, the male connector 10Y can be rotated about an axis thereof. Thus, the male connector 10Y can be fit into the female connector 20Y with the male connector 10Y being rotated about an axis thereof, ensuring reduction in time necessary for fitting the male connector 10Y into the female connector 20Y.

Inserting the guide shaft 13Y fully into the guide hole 221Y, the projections 132 are inserted into the grooves 221*a* of the guide hole 221Y, and hence, the projections 132 cannot move by the grooves 221*a* in directions other than a direction in which the male connector 10Y is fit into a female connector 20Y.

If the projection 132 and the groove 221*a* can be engaged with each other, the guide shaft 13*a* may be designed to include at least one projection 132, and the fitting shaft 22Y may be designed to include at least one groove 221*a*. In the case that a plurality of the projections 132 is formed like a gear on an outer surface of the guide shaft 13Y at a predetermined pitch, by designing the fitting shaft 22Y to include at least one groove 221*a*, one of the projections 132 can be inserted into the groove 221*a* when the male connector 10Y is fit into the female connector 20Y regardless of a rotational position of the male connector 10Y. Similarly, in the case that a plurality of the grooves 221*a* are formed like a gear at an inner surface of the guide hole 221Y, by designing the guide shaft 13Y to include at least one projection 132, the projection 132 can be inserted into one of the grooves 221*a* when the male connector 10Y is fit into the female connector 20Y regardless of a rotational position of the male connector 10Y. Consequently, the male connector 10Y can take any rotational position when the male connector 10Y is fit into the female connector 20Y.

In the above-mentioned electric connectors in accordance with the first to third embodiments, the male connector 10, 10X or 10Y is designed to include the guide shaft 13 or 13Y, and the female connector 20, 20X or 20Y is designed to include the guide hole 221 or 221Y into which the guide shaft 13 or 13Y is to be inserted. As an alternative, the male connector 10, 10X or 10Y may be designed to include the guide hole 221 or 221Y, and the female connector 20, 20X or 20Y may be designed to include the guide shaft 13 or 13Y.

In the above-mentioned first to third embodiments, the first contact terminal comprised of the cylindrical male contact terminals 12*a* to 12*c* is formed on an inner surface of the housing 11 or 11X, and the second contact terminal comprised of the female contact terminals 23*a* to 23*c* each comprised of a contact piece is formed on an outer surface of the fitting shaft 22 or 22Y. As an alternative, the male contact terminals 12*a* to 12*c* may be formed as the second contact terminal in the form of a contact piece on an inner surface of the housing 11 or 11X, and the female contact terminals 23*a* to 23*c* may be formed as the first contact terminal in the form of a cylinder coaxially on an outer surface of the fitting shaft 22 or 22Y, in which case, an inner diameter of the housings 11 and 11X and an outer diameter of the shafts 22 and 22Y may be designed to be smaller at a position closer to a proximal end of the guide shaft 13, ensuring that the male contact terminals do not make contact with the female contact terminals other than the corresponding female contact terminal while the male connector is being fit into the female connector.

Furthermore, the above-mentioned electric connectors in accordance with the first to third embodiments are designed to include three pairs of the male contact terminals 12*a* to 12*c* and the female contact terminals 23*a* to 23*c*. A number of pairs of the male contact terminals and the female contact terminals is not to be limited to three. One, two, four or more pairs may be selected.

In the above-mentioned electric connectors in accordance with the first to third embodiments, the male connector is connected to a device, and the female connector is connected to a cable. As an alternative, the male connector may be connected to a cable, and the female connector may be connected to a device.

INDUSTRIAL APPLICABILITY

The electric connector in accordance with the present invention can be broadly employed in fields such as electric, electronic and automobile industries, and used as a connector to be used for electric and electronic parts or a connector to be equipped in an automobile, such as a connector used in a glow plug, a connector for electrically connecting a combustion pressure sensor to a wire harness, or a connector for connecting cables to each other.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2012-225380 filed on Oct. 10, 2012 including specification, claims, drawings and summary is incorporated herein by reference in its entirety.

What is claimed is:

1. An electric connector including a male connector and a female connector, said male connector including a cylindrical main portion, and a male contact terminal formed at said main portion, said female connector including a hole into which said cylindrical main portion is fit, and a female contact terminal formed at said hole for making electrical contact with said male contact terminal when said main portion is fit into said hole, one of said male connector and said female connector including a guide shaft axially extending in a direction in which said male connector is fit into said female connector, the other of said male connector and said female connector including a guide hole for allowing said guide shaft to be inserted thereinto to guide said guide shaft in said direction, one of said male contact terminal and said female contact terminal being comprised of at least one cylindrical first terminal arranged coaxially with said guide shaft, and the other of said male contact terminal and said female contact terminal being comprised of a second terminal arranged in correspondence to said cylindrical first terminal, said second terminal including a contact portion exposed outside for making contact with said cylindrical first terminal, and an embedded portion being embedded in the other of said male contact terminal and said female contact terminal, said embedded portion being outwardly bent at opposite ends thereof to thereby define curved portions, said curved portions being inserted into a housing of said electric connector, said cylindrical main portion of said male connector including a first portion and a second portion adjacent to said first portion and located remote from a distal end of said main portion, said first portion being cylindrical, said second portion including a main portion projection extending outwardly from a surface of said second portion, said female connector including a stopper for engaging said main portion projection to prevent said male connector from rotating about an axis thereof, and said main portion projection having a diameter smaller than a diameter of said first portion.

2. The electric connector as set forth in claim 1, wherein said cylindrical first terminal is one of a plurality of first terminals, said one of said male contact terminal and said female contact terminal being comprised of said plurality of said first terminals, a remote one of said first terminals disposed more remote from a distal end of said guide shaft having a smaller diameter than a remainder of said first terminals.

3. The electric connector as set forth in claim 1, wherein said guide shaft extends at a distal end thereof beyond said one of said male connector and said female connector.

4. The electric connector as set forth in claim 1, wherein said guide hole is disposed at a distal end thereof on a level with or inwardly of an opening end of said other of said male connector and said female connector.

5. The electric connector as set forth in claim 1, wherein said projection is in the form of a gear.

6. The electric connector as set forth in claim 1, wherein said guide shaft includes a first portion and a second portion adjacent to said first portion and disposed remote from a distal end of said guide shaft, said first portion being cylindrical, said second portion including a guide shaft projection extending outwardly from a surface of said second portion, said guide hole being formed at an inner surface thereof with a groove making engagement with said guide shaft projection to prevent said male connector from rotating about an axis thereof.

7. The electric connector as set forth in claim 6, wherein said guide shaft projection is in the form of a gear.

8. The electric connector as set forth in claim 1, wherein said stopper extends inwardly of a housing of said female connector from outside of said housing through an opening formed at a surface of said housing, to make engagement with said projection.

* * * * *